US012741196B1

(12) United States Patent
Yang

(10) Patent No.: US 12,741,196 B1
(45) Date of Patent: Sep. 22, 2026

(54) ADJUSTABLE PUZZLE TABLE

(71) Applicant: Lixin Yang, Langfang (CN)

(72) Inventor: Lixin Yang, Langfang (CN)

( * ) Notice: Subject to any disclaimer, the term of this patent is extended or adjusted under 35 U.S.C. 154(b) by 0 days.

(21) Appl. No.: 19/437,162

(22) Filed: Dec. 30, 2025

(51) Int. Cl.

| | |
|---|---|
| ***A47B 11/00*** | (2006.01) |
| ***A47B 13/08*** | (2006.01) |
| ***A47B 27/02*** | (2006.01) |
| ***A47B 88/453*** | (2017.01) |
| ***A47B 97/02*** | (2006.01) |
| ***A63F 9/10*** | (2006.01) |

(52) U.S. Cl.
CPC ..... *A63F 9/1044* (2013.01); *A47B 11/00* (2013.01); *A47B 13/081* (2013.01); *A47B 27/02* (2013.01); *A47B 88/453* (2017.01); *A47B 97/02* (2013.01); *A47B 2200/0043* (2013.01); *A47B 2220/0002* (2013.01)

(58) Field of Classification Search
CPC ..... A63F 9/1044; A63F 3/00261; A63F 2003/00274; A63F 2003/00952; A63F 2009/105; A47B 88/453; A47B 11/00; A47B 13/081; A47B 27/02; A47B 97/02; A47B 2200/0043; A47B 2220/002; A47B 25/00; A47B 13/083; A47B 83/045
USPC .... 108/6, 7, 9, 29, 139, 142, 28, 25, 26, 94, 108/95, 103, 104; 384/58, 615; 273/237, 273/280, 153 R, 157 R; D21/478; 248/316.7
See application file for complete search history.

(56) References Cited

U.S. PATENT DOCUMENTS 573,703 A * 12/1896 Robbins
2,854,148 A * 9/1958 Mattos ..... D06F 81/006 D32/66
3,433,485 A * 3/1969 Renn ..... A63F 9/10 434/84
3,682,109 A * 8/1972 Gordon ..... A47B 13/081 108/9
4,142,726 A * 3/1979 Anderson ..... A63F 9/1044 40/768
5,009,382 A * 4/1991 Huffaker ..... A47B 23/02 248/442.2
5,624,118 A * 4/1997 Gottesman ..... A63F 9/1044 40/739

(Continued)

FOREIGN PATENT DOCUMENTS

CN 114470731 A * 5/2022 ..... A63F 9/001
EP 0083294 A1 * 7/1983 ..... A63F 3/00895

(Continued)

OTHER PUBLICATIONS

JP2007252491 English translation (Year: 2007).*

*Primary Examiner* — Janet M Wilkens

(57) ABSTRACT

An adjustable puzzle table, comprising a frame. Both sides of the frame are provided with multiple drawers, and the middle part of the frame is provided with multiple drawer spring mechanisms, which cooperate with the drawers to assist in ejecting the drawers from the drawer cavities. The back of the frame is rotatably provided with an adjustable support mechanism for supporting the frame and enabling adjustment of the frame's tilt angle. The bottom of the adjustable support mechanism is provided with a rotating component, thereby allowing the puzzle table to rotate 360 degrees horizontally. The front end of the frame is provided with an adjustable hanging rack for hanging posters, placards.

8 Claims, 14 Drawing Sheets

(56) References Cited

U.S. PATENT DOCUMENTS

| | | | | |
|---|---|---|---|---|
| 9,855,493 | B1 * | 1/2018 | Pratt | A63F 9/12 |
| 12,048,885 | B2 * | 7/2024 | Che | A63F 9/1044 |
| 12,097,443 | B2 * | 9/2024 | Che | A47B 13/088 |
| 12,186,676 | B2 * | 1/2025 | Che | A47B 13/088 |
| D1,082,941 | S * | 7/2025 | Che | D21/478 |
| 2021/0170268 | A1 * | 6/2021 | Malki | A63F 9/1044 |
| 2025/0073571 | A1 * | 3/2025 | Zhang | A63F 9/1044 |
| 2026/0027451 | A1 * | 1/2026 | Deng | A47B 37/00 |

FOREIGN PATENT DOCUMENTS

| | | | | | |
|---|---|---|---|---|---|
| EP | 4520412 | A2 * | 3/2025 | | A63F 9/1044 |
| JP | 2007252491 | A * | 10/2007 | | |
| KR | 20150063890 | A * | 6/2015 | | B63B 29/04 |
| WO | WO-2025260323 | A1 * | 12/2025 | | A63F 9/1044 |

* cited by examiner

ADJUSTABLE PUZZLE TABLE

FIELD OF THE INVENTION

The present invention relates to the field of puzzle tables, and more particularly, to an adjustable puzzle table.

BACKGROUND

Puzzles are a widely popular intellectual and recreational activity. Traditionally, puzzles are typically assembled on a flat tabletop or the floor, requiring users to maintain a hunched-over or downward-looking posture for extended periods, which can easily lead to fatigue and discomfort in the neck and lumbar spine. To improve the experience, dedicated puzzle boards or puzzle mats have emerged on the market. These are usually flat structures that allow incomplete puzzles to be moved as a whole, but they still cannot adjust their tilt angle to accommodate the height and sitting posture of different users, resulting in a suboptimal experience.

Furthermore, large puzzles often require reference to a complete sample image. The existing method typically involves placing the sample image flat next to the puzzle, which not only occupies the already limited puzzle space but also forces users to frequently turn their heads or shift their gaze for comparison, easily causing confusion and eye strain. During the puzzle assembly process, it is sometimes necessary to rotate the puzzle board to work from different angles. A fixed puzzle board requires users to move themselves or laboriously lift and turn the entire board, which is extremely inconvenient. Simultaneously, the storage of puzzle pieces is often problematic. Loose piece boxes are prone to tipping over and are not convenient for organized storage alongside the puzzle board.

Therefore, to address the aforementioned technical problems, an adjustable puzzle table is designed.

SUMMARY

The technical problem to be solved by the present invention is to overcome the deficiencies of the prior art described above and to provide an adjustable puzzle table.

To solve the aforementioned technical problem, the technical solution provided by the present invention is an adjustable puzzle table, comprising: a frame, drawers, an adjustable support mechanism, a rotating component, and an adjustable hanging rack. Both side ends of the frame are symmetrically provided with multiple drawer cavities, each drawer cavity is provided with a drawer. A middle portion of the frame is provided with a folding storage cavity. Both side walls of the folding storage cavity, at positions corresponding to the drawer cavities, are each provided with multiple drawer spring mechanisms. The drawer spring mechanisms extend into the drawer cavities and cooperate with the drawers to assist in ejecting the drawers from the drawer cavities. The folding storage cavity is rotatably provided with the adjustable support mechanism for supporting the frame and enabling adjustment of a tilt angle of the frame. A bottom of the adjustable support mechanism is provided with the rotating component, thereby allowing the puzzle table to rotate 360 degrees in a horizontal direction. A front end of the frame is provided with the adjustable hanging rack for hanging posters, placards, and the like.

Optionally, a drawing board is provided above the frame, and the drawing board is provided with a U-shaped frame.

Optionally, the adjustable support mechanism comprises a base frame and a support frame. The base frame is disposed within the folding storage cavity, and a rear end of the base frame is rotatably connected to both side walls of the folding storage cavity via bolts. Both side walls of another end of the base frame are uniformly provided with multiple positioning slots. The folding storage cavity is rotatably provided with the support frame. The support frame cooperates with the positioning slots for supporting the frame and stabilizing an adjusted position of the frame.

Optionally, the rotating component comprises a circular frame, a circular base, steel balls, and a positioning bolt. The circular frame is internally provided with a mounting bracket connected to the base frame via bolts. The circular frame is internally provided with an annular groove, a top portion inside the annular groove is provided with a circular track. An upper interior of the circular base is uniformly provided with multiple steel ball seats, each steel ball seat is provided with a steel ball. The circular base is disposed within the annular groove, and the steel balls are in rolling cooperation with the circular track, thereby enabling relative rotation between the circular base and the circular frame. A side wall of the circular frame is provided with an aperture extending into the annular groove. An outer side wall of the circular frame is provided with an internally threaded sleeve coaxial with the aperture. The internally threaded sleeve is provided with the positioning bolt. The positioning bolt cooperates with the circular base for positioning the circular base.

Optionally, both side walls of the annular groove are uniformly provided with multiple rubber protrusions. Both side walls of the circular base are provided with rubber rings. The rubber rings cooperate with the rubber protrusions to provide a predetermined resistance.

Optionally, the adjustable hanging rack comprises a mounting plate, a telescopic rod, a three-way connector, and a crossbar. The mounting plate is connected to the frame via bolts. An upper end of the mounting plate is symmetrically provided with connecting lugs. A swivel base is disposed between the two connecting lugs. The swivel base is provided with a through hole penetrating laterally through the two connecting lugs. The through hole is provided with a bolt, and the swivel base is rotatably connected to the connecting lugs via the bolt. Both sides of the swivel base and inner sides of the two connecting lugs are provided with teeth. The teeth on both sides of the swivel base mesh with the teeth on the inner sides of the two connecting lugs, thereby achieving positioning of the swivel base. An upper end of the swivel base is provided with the telescopic rod. An upper end of the telescopic rod is provided with the three-way connector, and the three-way connector is provided with the crossbar for hanging posters and the like.

Optionally, both sides of the three-way connector on the crossbar are provided with clamps.

Optionally, an end of the frame opposite to the adjustable hanging rack is provided with a handle.

Optionally, a rear side of the end of the frame provided with the adjustable hanging rack is symmetrically provided with hooks.

Compared with the prior art, the present invention offers the following advantages:

The frame is provided with a folding storage cavity in its middle portion, within which an adjustable support mechanism is rotatably disposed. This mechanism supports the frame, enabling adjustment of its tilt angle and allowing it to be folded flat. This accommodates users of different heights and makes the table suitable for use in various puzzle assembly scenarios.

The bottom of the adjustable support mechanism is provided with a rotating component, which allows the puzzle table to rotate 360 degrees horizontally. This enables users to easily rotate the table to their desired angle without needing to change their own position, making continued puzzle assembly more convenient.

The steel balls engage in rolling cooperation with the circular track, allowing relative rotation between the circular base and the circular frame. Multiple rubber protrusions are uniformly arranged on both side walls of the annular groove, and rubber rings are provided on both side walls of the circular base. The cooperation between the rubber rings and the rubber protrusions creates a predetermined resistance. On one hand, this allows users to push the table to the desired angle with minimal force; on the other hand, it prevents sudden rotation or excessive rotation angles.

The drawer spring mechanisms are provided. With a light press on a drawer, it is smoothly ejected by the corresponding drawer spring mechanism without any obstruction, facilitating convenient access to puzzle pieces.

The front end of the frame is provided with an adjustable hanging rack. This allows a reference poster to be directly secured, enabling convenient visual comparison during puzzle assembly. Furthermore, its height is adjustable, promoting better spinal posture by eliminating the need for users to look down, thereby enhancing the overall puzzle assembly experience.

BRIEF DESCRIPTION OF THE DRAWINGS

As shown in FIGS. 1-14:

Figure 1:
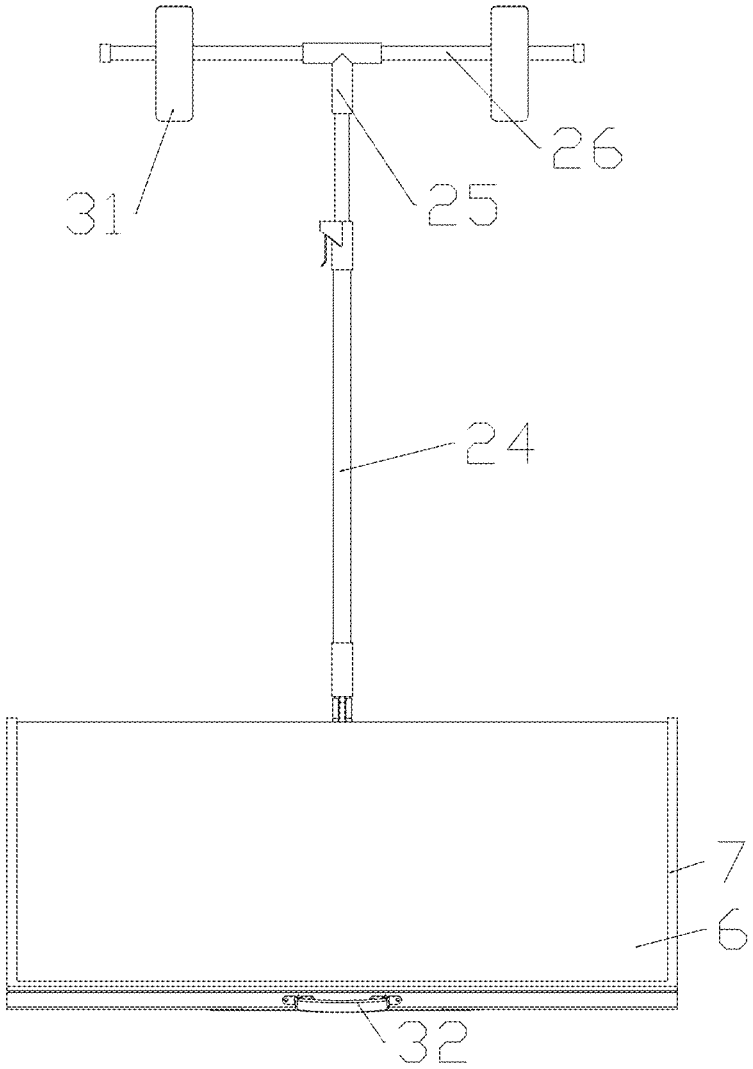
FIG. 1 is a front view of an adjustable puzzle table according to the present invention.
Figure 2:
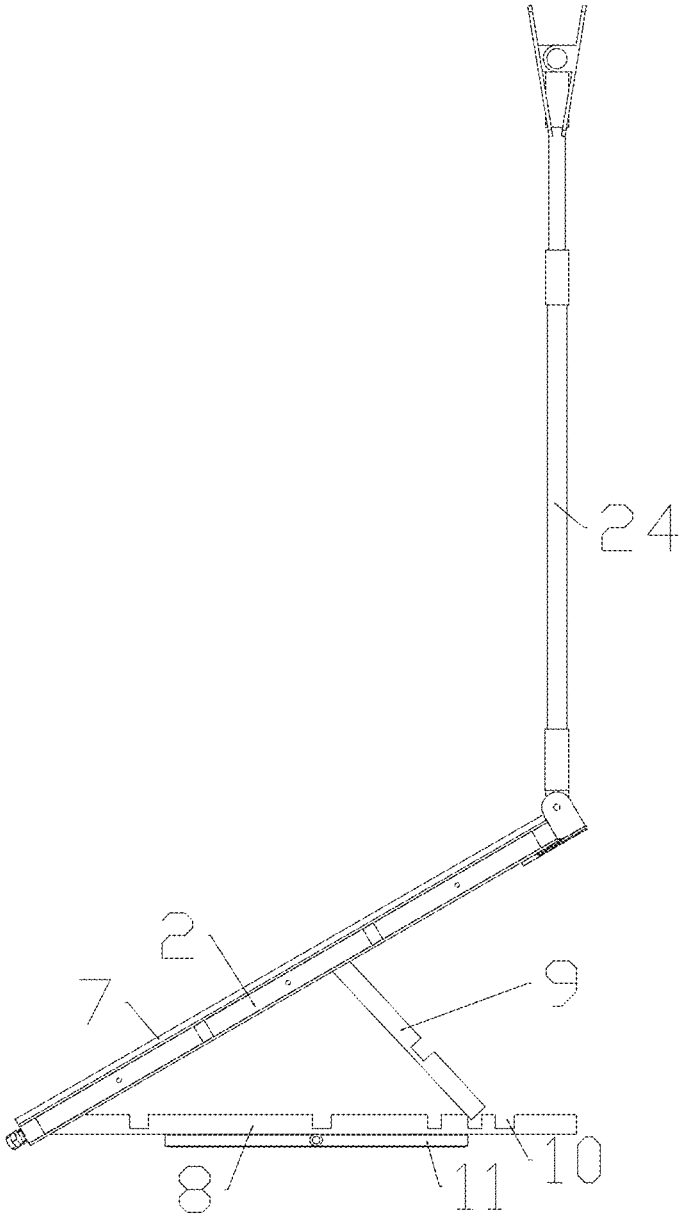
FIG. 2 is a right-side view of the adjustable puzzle table according to the present invention.
Figure 3:
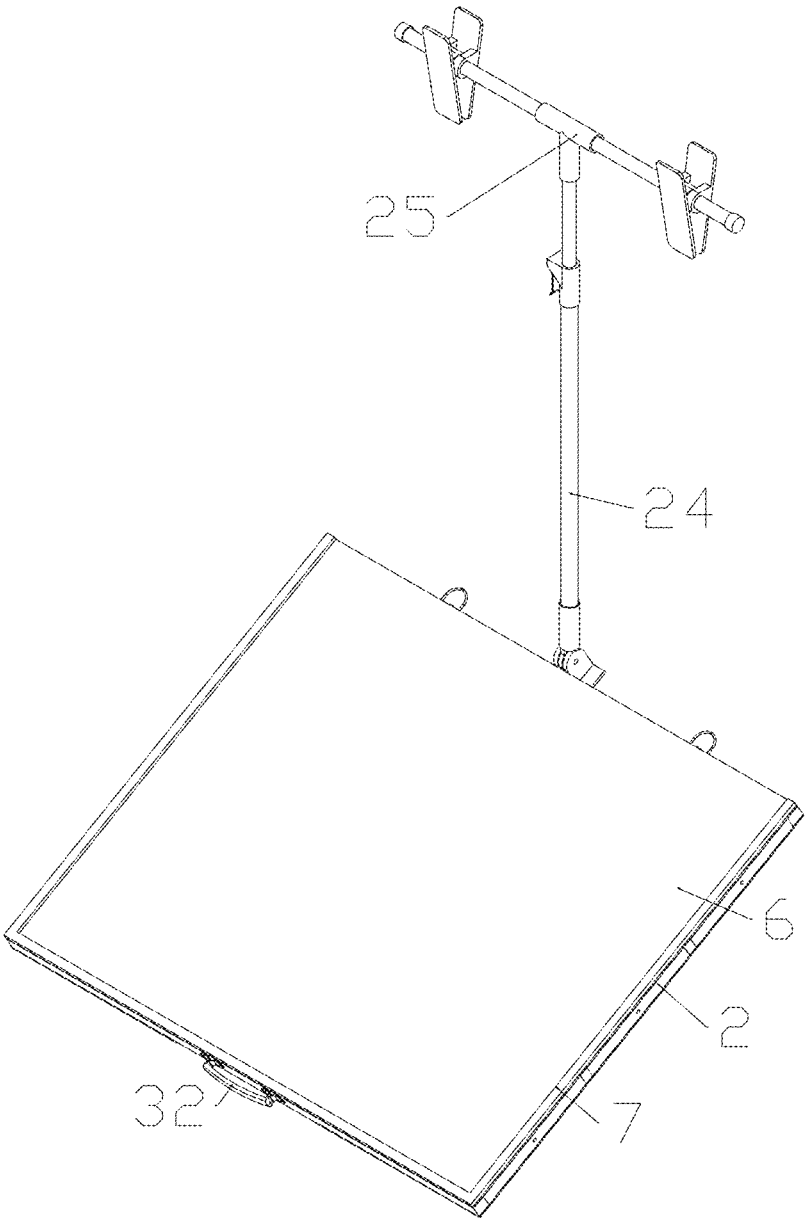
FIG. 3 is a top perspective schematic view of the adjustable puzzle table according to the present invention.
Figure 4:
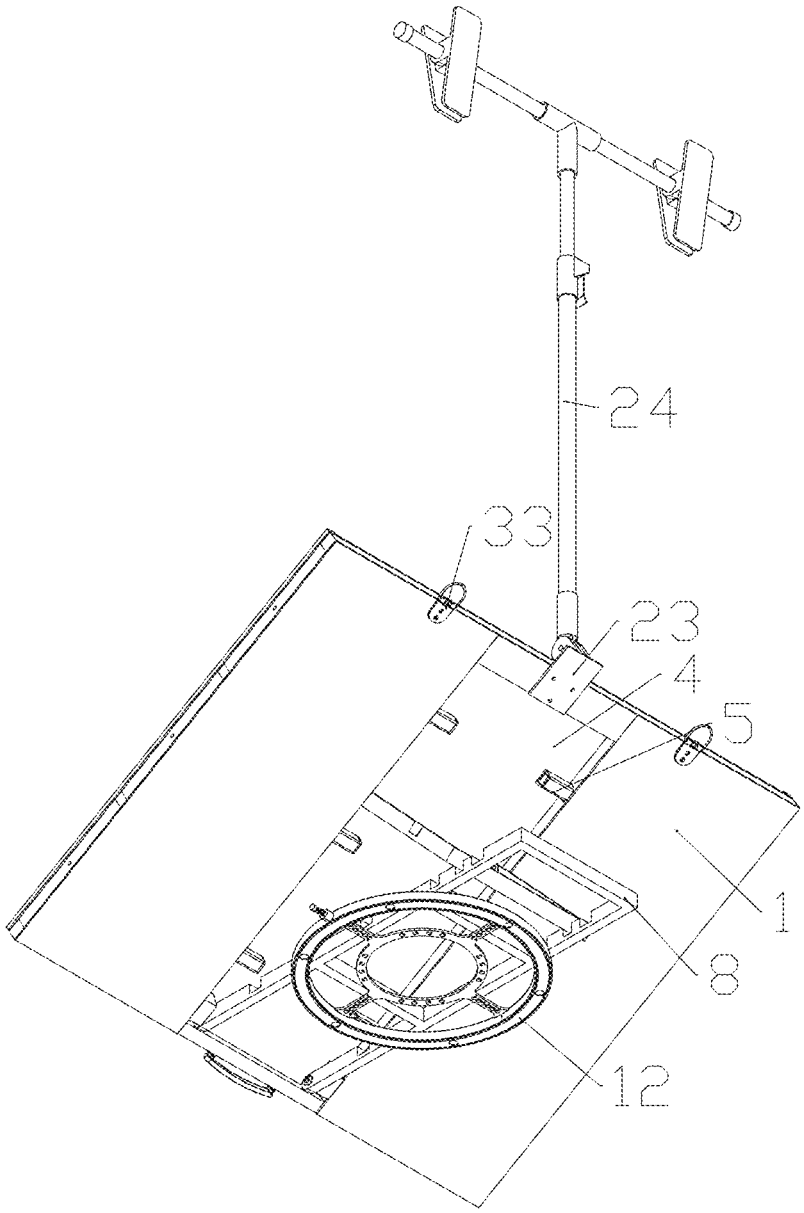
FIG. 4 is a bottom perspective schematic view of the adjustable puzzle table according to the present invention.
Figure 5:
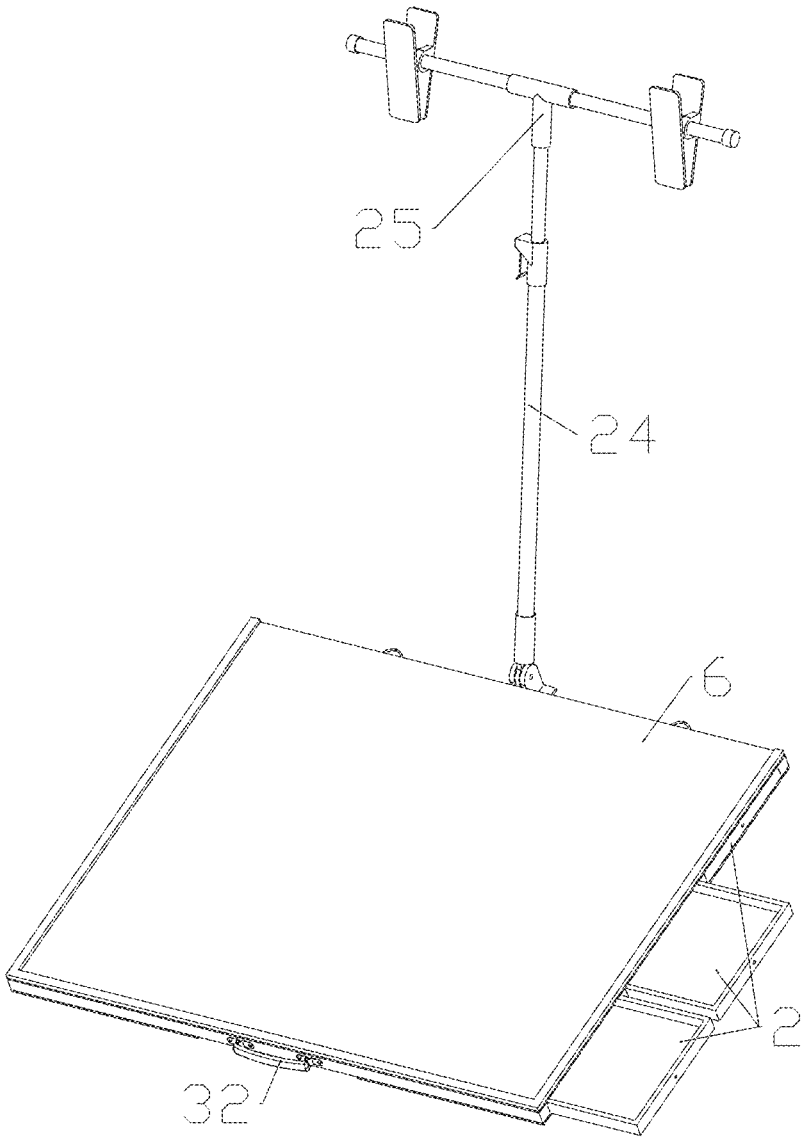
FIG. 5 is a top perspective schematic view of the adjustable puzzle table with drawers extended.
Figure 6:
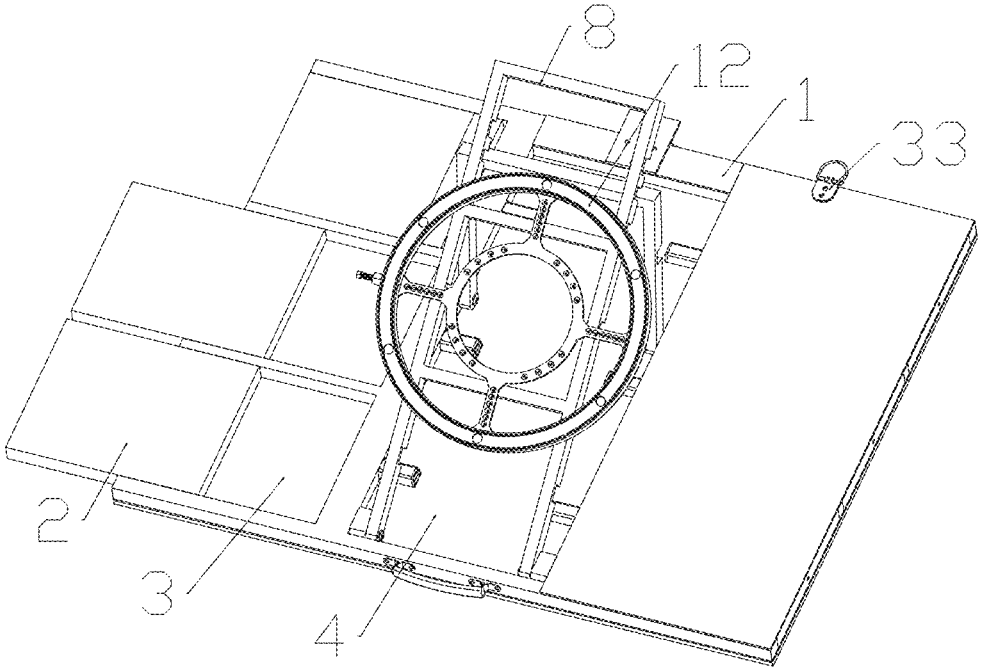
FIG. 6 is a bottom perspective schematic view of the adjustable puzzle table with drawers extended.
Figure 7:
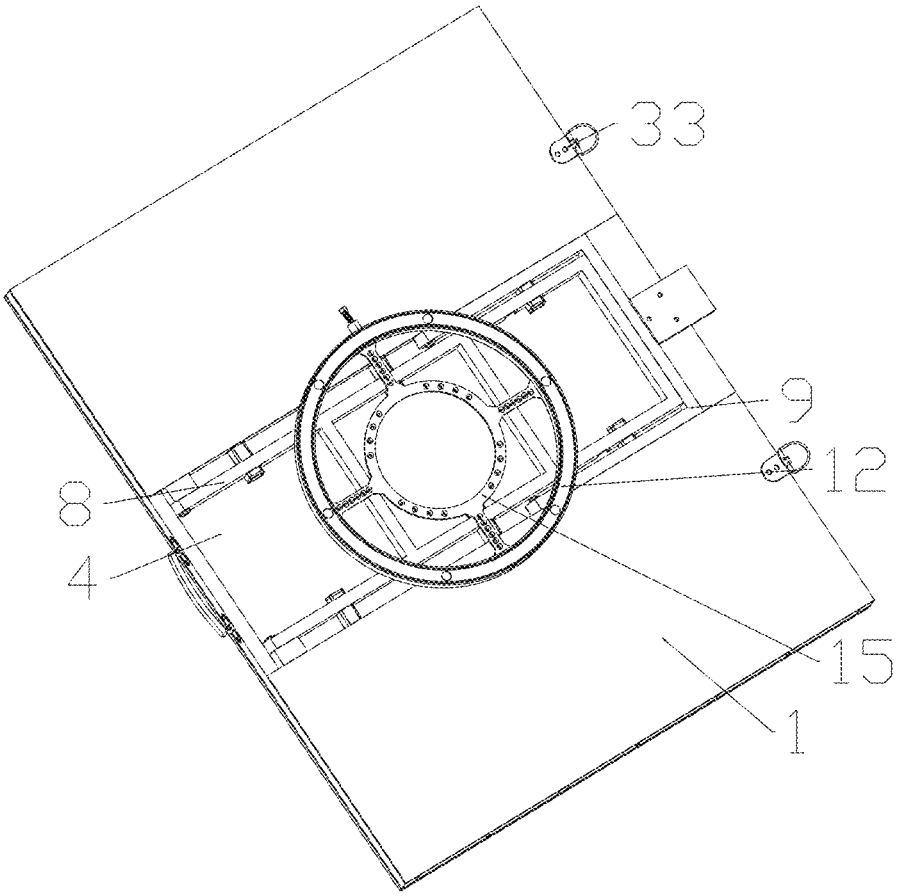
FIG. 7 is a schematic view illustrating the adjustable puzzle table in a folded state.
Figure 8:
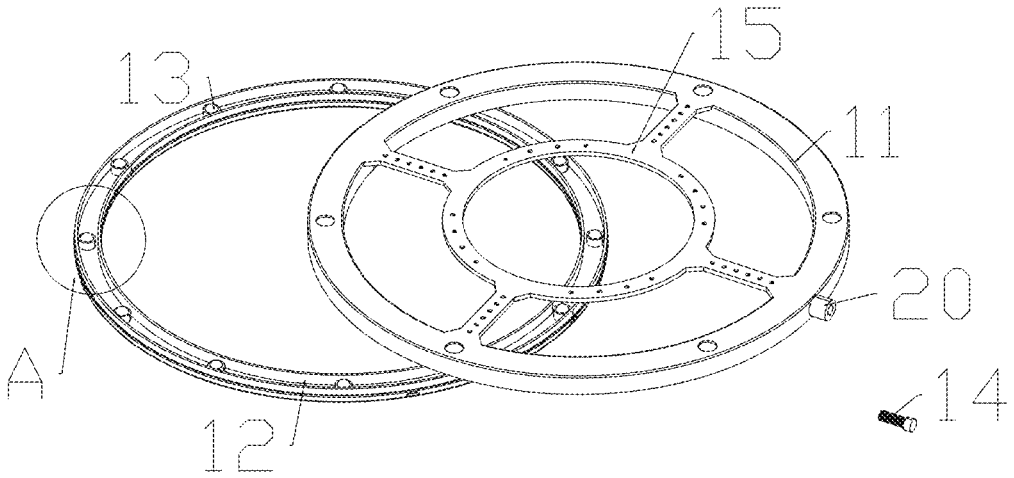
FIG. 8 is an exploded schematic view of a rotating component of the adjustable puzzle table.
Figure 9:
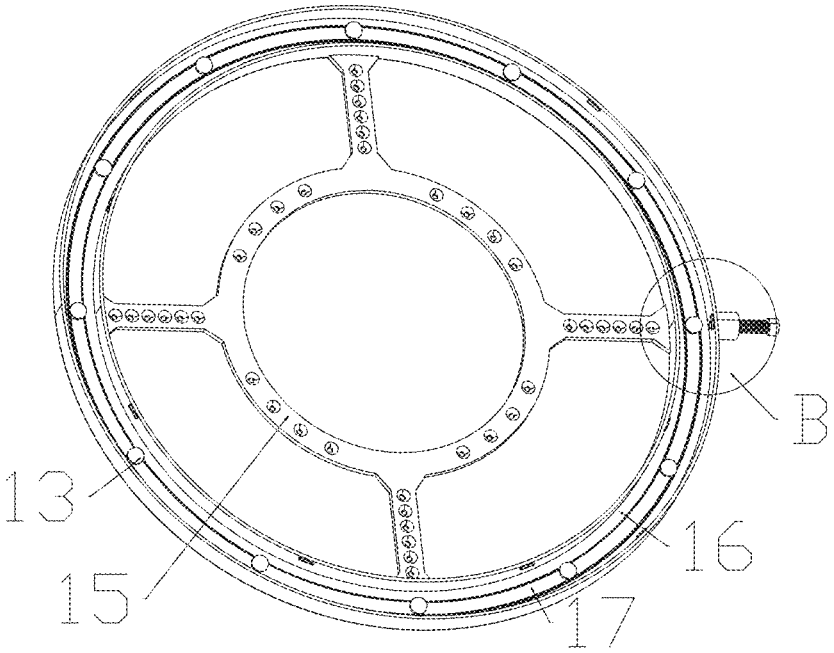
FIG. 9 is an internal structural schematic view of a circular frame of the adjustable puzzle table.
Figure 10:
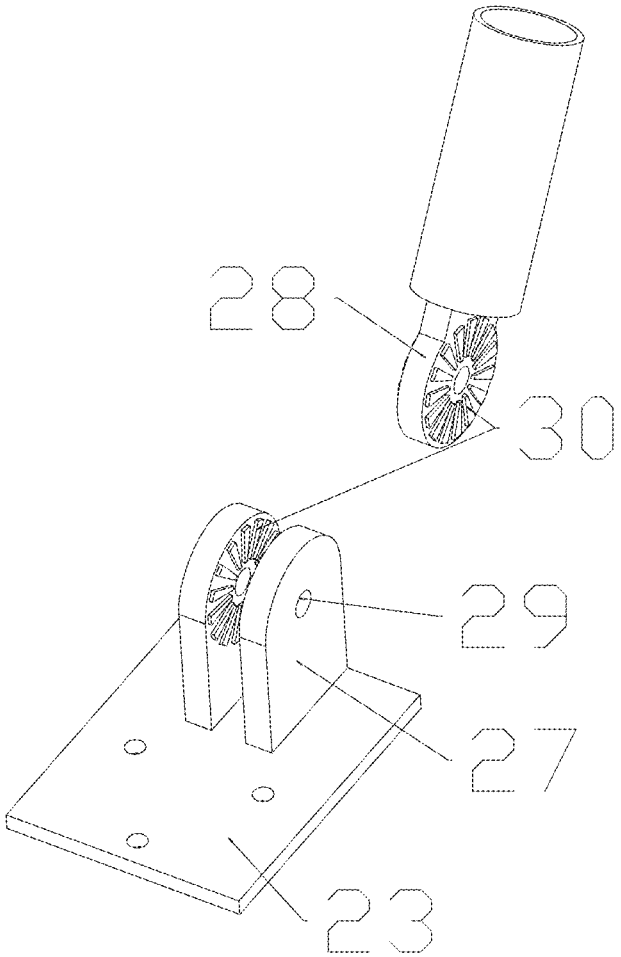
FIG. 10 is an exploded schematic view of a mounting plate, connecting lugs, and a swivel base of the adjustable puzzle table.
Figure 11:
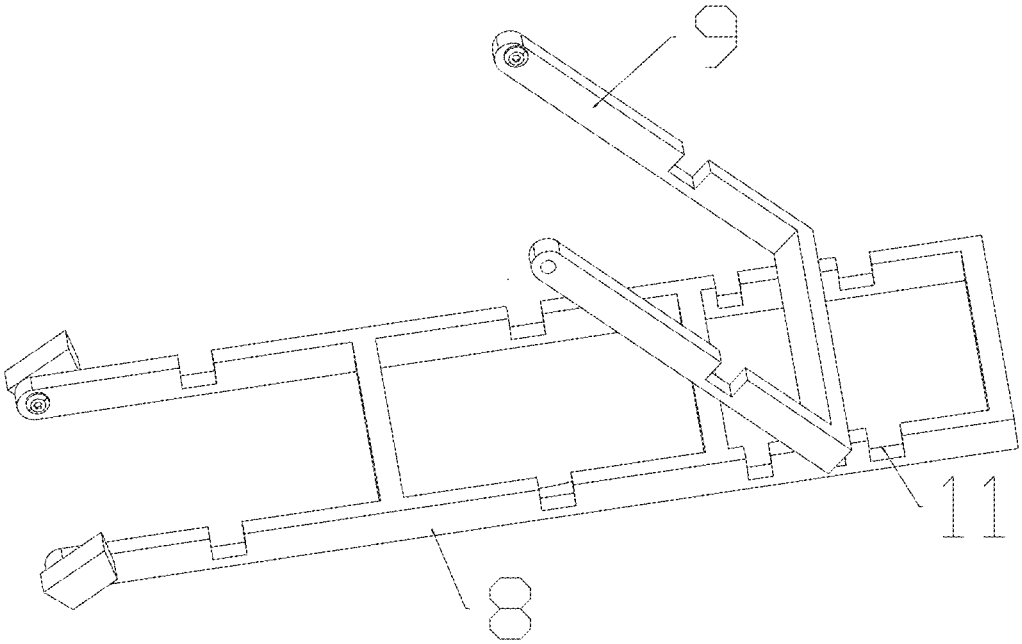
FIG. 11 is a structural schematic view of an adjustable support mechanism of the adjustable puzzle table.
Figure 12:
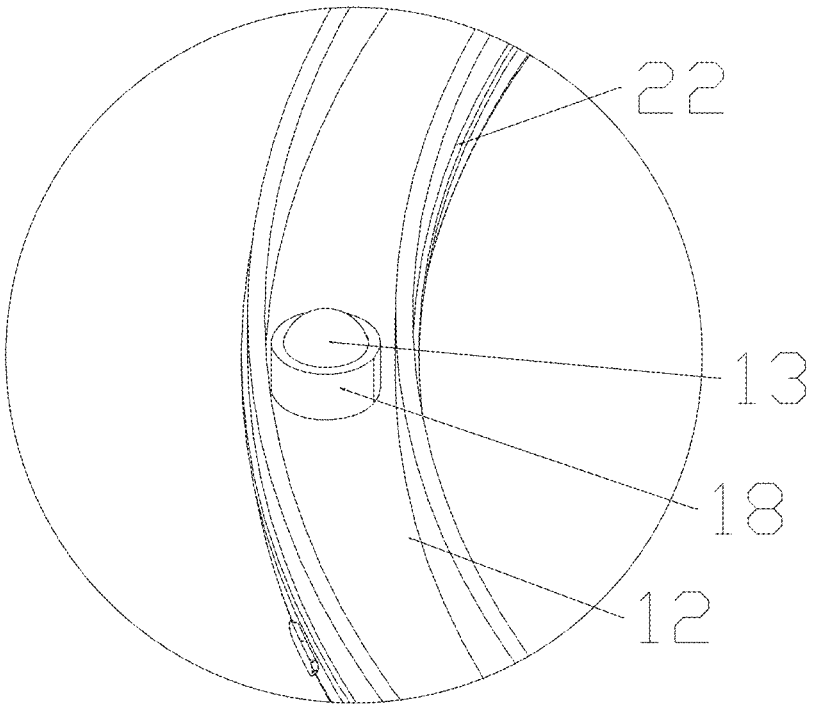
FIG. 12 is a partial enlarged view of area A in FIG. 8.
Figure 13:
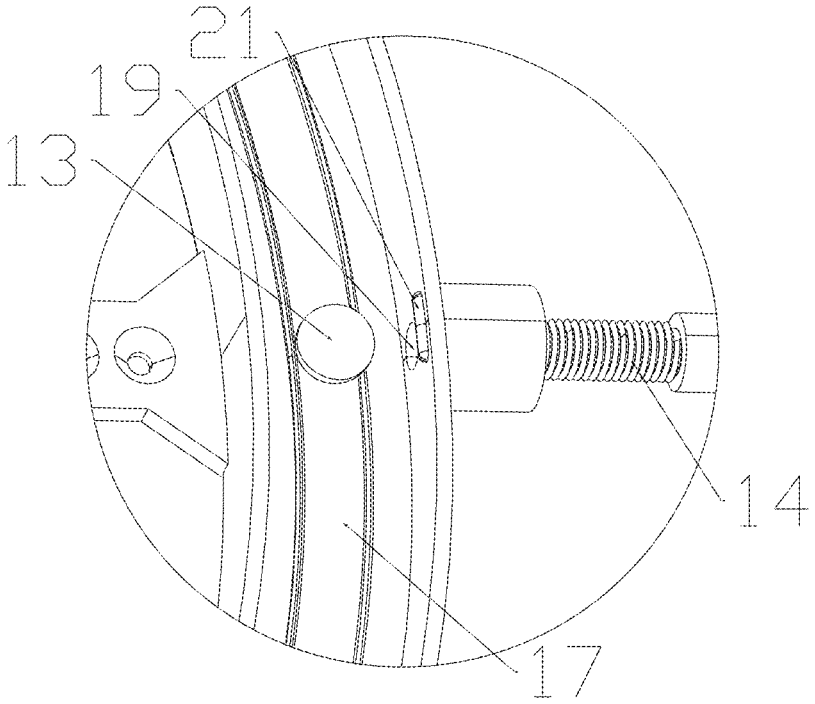
FIG. 13 is a partial enlarged view of area B in FIG. 9.

1. Frame
2. Drawer
3. Drawer cavity
4. Folding storage cavity
5. Drawer spring mechanism
6. Drawing board
7. U-shaped frame
8. Base frame
9. Support frame
10. Positioning slot
11. Circular frame
12. Circular base
13. Steel ball
14. Positioning bolt
15. Mounting bracket
16. Annular groove
17. Circular track
18. Steel ball seat
19. Aperture
20. Threaded sleeve
21. Rubber protrusion
22. Rubber ring
23. Mounting plate
24. Telescopic rod
25. Three-way connector
26. Crossbar
27. Connecting lug
28. Swivel base
29. Through hole
30. Tooth
31. Clamp
32. Handle
33. Hook While the technology is susceptible to various modifications and alternative forms, specifics thereof have been shown by way of example and drawings, and will be described in detail. It should be understood, however, that the application is not limited to the particular embodiments described. On the contrary, the application is to cover modifications, equivalents, and alternatives falling within the spirit and scope of the technology.

DETAILED DESCRIPTION OF EMBODIMENTS

The embodiments of the present technology described herein are not intended to be exhaustive or to limit the technology to the precise forms disclosed in the following detailed description. Rather, the embodiments are chosen and described so that others skilled in the art can appreciate and understand the principles and practices of the present technology.

All publications and patents mentioned herein are hereby incorporated by reference. The publications and patents disclosed herein are provided solely for their disclosure. Nothing herein is to be construed as an admission that the inventors are not entitled to antedate any publication and/or patent, including any publication and/or patent cited herein.

The following provides a further detailed description of the adjustable puzzle table according to the present invention with reference to the accompanying drawings.

With reference to FIGS. 1-14, an adjustable puzzle table includes a frame 1, drawers 2, an adjustable support mechanism, a rotating component, and an adjustable hanging rack. Both side ends of the frame 1 are symmetrically provided with multiple drawer cavities 3. Each drawer cavity 3 is provided with a drawer 2 for the categorized storage of puzzle pieces from different areas or of different types, thereby keeping the tabletop tidy. A middle portion of the frame 1 is provided with a folding storage cavity 4 having a downward-facing opening. Both side walls of the folding storage cavity 4, at positions corresponding to the drawer cavities 3, are each provided with multiple drawer spring mechanisms 5. The movable end of each drawer spring mechanism 5 extends into a corresponding drawer cavity 3 and cooperates with the end of the drawer 2. When a drawer 2 needs to be opened, the user simply gently presses the drawer 2 to activate the drawer spring mechanism 5. The spring force of the mechanism 5 then assists in smoothly and effortlessly ejecting the drawer 2 from the drawer cavity 3, allowing for very convenient access to the pieces. The folding storage cavity 4 is rotatably provided with the adjustable support mechanism for supporting the frame 1 and enabling adjustment of the tilt angle of the frame 1. The bottom of the adjustable support mechanism is provided with the rotating component, thereby allowing the puzzle table to rotate 360 degrees in the horizontal direction. The front end of the frame 1 is provided with the adjustable hanging rack for hanging posters, placards, and the like.

Specifically, as shown in FIGS. 1-7, three drawers 2 are provided on each side of the frame 1, meaning the entire puzzle table is configured with a total of six drawers.

Figure 14:
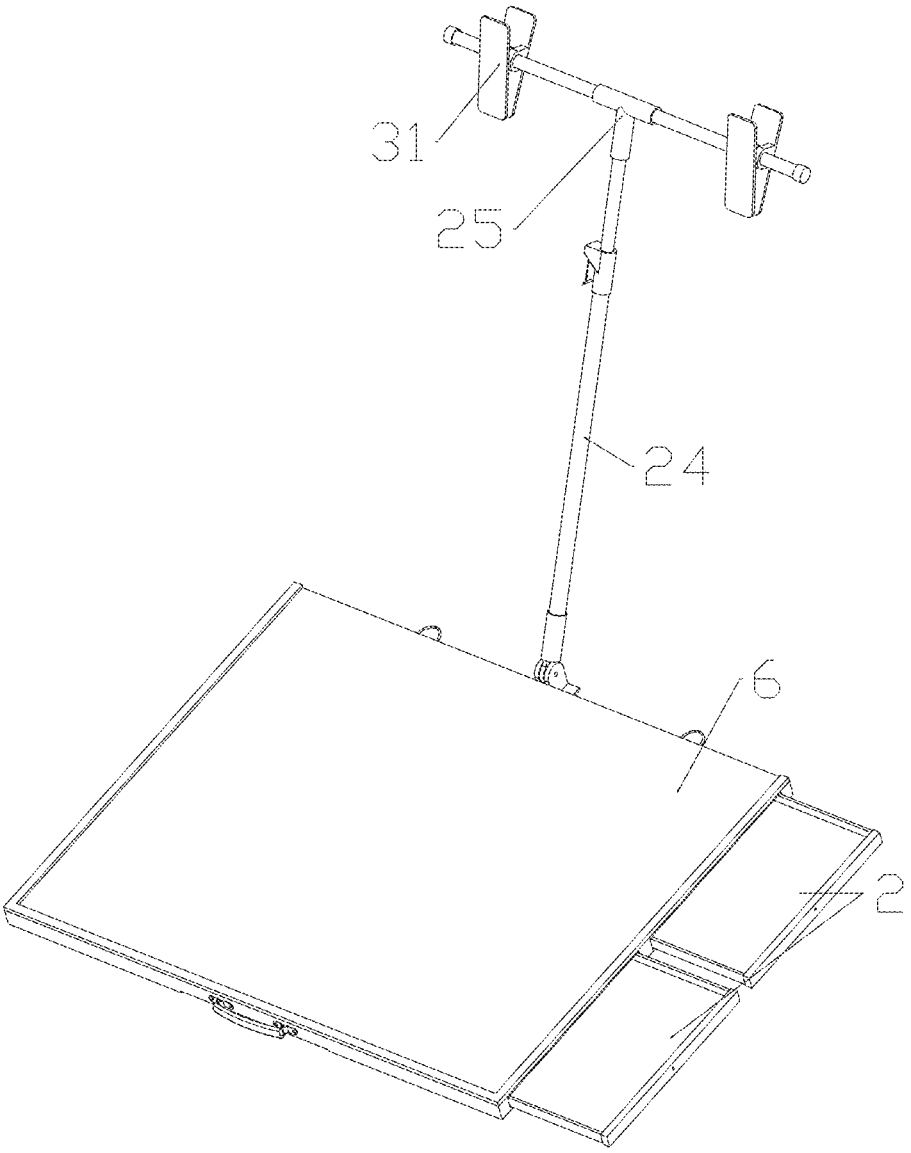
FIG. 14 is a structural schematic view of the adjustable puzzle table configured with four drawers.

Specifically, as shown in FIG. 14, two drawers 2 are provided on each side of the frame 1, meaning the entire puzzle table is configured with a total of four drawers.

The frame 1 is provided with a drawing board 6 above it, which serves as the support surface for puzzle assembly. The drawing board 6 is provided with a U-shaped frame 7 to prevent puzzle pieces from sliding off the edges.

The adjustable support mechanism comprises a base frame 8 and a support frame 9. The base frame 8 is disposed within the folding storage cavity 4, and the rear end of the base frame 8 is rotatably connected to both side walls of the folding storage cavity 4 via bolts, allowing the base frame 8 to pivot about these bolts. Both side walls of the other end of the base frame 8 are uniformly provided with multiple positioning slots 10. The folding storage cavity 4 is rotatably provided with the support frame 9. The support frame 9 has a U-shaped frame structure, with its top ends on both sides being rotatably connected via pivot shafts to the front interior of the folding storage cavity 4. The support frame 9 cooperates with the positioning slots 10 to support the frame 1 and stabilize its adjusted position.

Specifically: When adjustment of the tabletop tilt angle is required, the user lifts the front end of the frame 1, causing the support frame 9 to rotate downwards. The crossbar at its bottom can then engage different positioning slots 10 on the base frame 8, thereby achieving support and fixation of the frame 1 (i.e., the tabletop) at various tilt angles.

When not in use, the support frame 9 is disengaged from the positioning slots 10, rotated upwards, and pushed into the folding storage cavity 4. Simultaneously, the base frame 8 is also rotated upwards until it conforms to the inner wall of the folding storage cavity 4. This allows for complete storage of the entire support mechanism, transforming the puzzle table into a flat, thin board for easy storage or transportation.

The rotating component comprises a circular frame 11, a circular base 12, steel balls 13, and a positioning bolt 14. The circular frame 11 is internally provided with a mounting bracket 15. The mounting bracket 15 is provided with multiple mounting holes and is connected to the base frame 8 via bolts passing through these mounting holes. The presence of multiple mounting holes allows for the selection of the appropriate hole for installation based on factors such as the width of the adjustable support mechanism when attaching the rotating component to it, enabling the rotating component to adapt to adjustable support mechanisms of more models. The circular frame 11 is internally provided with an annular groove 16. A top portion inside the annular groove 16 is provided with a circular track 17. An upper interior of the circular base 12 is uniformly embedded, along its circumference, with multiple steel ball seats 18. Each steel ball seat 18 is provided with a steel ball 13, with a portion of the steel ball 13 protruding above the upper surface of the base. During assembly, the circular base 12 is disposed within the annular groove 16. At this point, the protruding steel balls 13 contact the lower surface of the circular track 17, forming a rolling cooperation. This design allows the circular base 12, which carries the entire frame 1 and support mechanism above it, to rotate smoothly and with low resistance relative to the circular frame 11.

To lock the position after adjustment to a suitable angle, the side wall of the circular frame 11 is provided with an aperture 19 extending into the annular groove 16. The outer side wall of the circular frame 11 is provided with an internally threaded sleeve 20, which is coaxial with the aperture 19. The internally threaded sleeve 20 is provided with the positioning bolt 14. When the positioning bolt 14 is tightened, its end can press against the side wall of the circular base 12, generating friction to prevent rotation and achieve positioning. When the positioning bolt 14 is loosened, its end moves away from the side wall of the circular base 12, allowing relative rotation between the circular frame 11 and the circular base 12, thereby enabling adjustment of the puzzle table's orientation.

To provide moderate rotational damping and prevent the tabletop from rotating freely due to slight contact, both side walls of the annular groove 16 are uniformly provided with multiple rubber protrusions 21. Correspondingly, both side walls of the circular base 12 are provided with rubber rings 22. The rubber rings 22 cooperate with the rubber protrusions 21 to create a predetermined resistance.

Specifically, when the circular base 12 rotates within the annular groove 16, the rubber rings 22 compress and rub against the rubber protrusions 21 on both sides, forming uniform resistance. This allows the user to rotate the tabletop with minimal force while achieving a stable and controllable rotation experience, preventing sudden slippage or inertial rotation.

The adjustable hanging rack comprises a mounting plate 23, a telescopic rod 24, a three-way connector 25, and a crossbar 26. The mounting plate 23 is connected to the frame 1 via bolts. The upper end of the mounting plate 23 is symmetrically provided with connecting lugs 27. A swivel base 28 is disposed between the two connecting lugs 27. The swivel base 28 is provided with a through hole 29, which penetrates laterally through the two connecting lugs 27. The through hole 29 is provided with a bolt, and the swivel base 28 is rotatably connected to the connecting lugs 27 via the bolt. Crucially, both sides of the swivel base 28 and the inner sides of the two connecting lugs 27 are provided with teeth 30. The teeth 30 on both sides of the swivel base 28 mesh with the teeth 30 on the inner sides of the two connecting lugs 27, thereby achieving positioning of the swivel base 28.

Specifically, when force is applied to rotate the swivel base 28, the teeth 30 on both sides of the swivel base 28 disengage from the teeth 30 on the inner sides of the connecting lugs 27. This allows the swivel base 28 to rotate when force is applied, thereby adjusting its angle. When the rotation of the swivel base 28 stops, the teeth 30 on both sides of the swivel base 28 re-engage with the teeth 30 on the inner sides of the connecting lugs 27. Under the preload force of the bolt, self-locking positioning is achieved, preventing the hanging rack from tilting downward on its own due to load.

The upper end of the swivel base 28 is provided with the telescopic rod 24, allowing height adjustment. The upper end of the telescopic rod 24 is provided with the three-way connector 25, and the three-way connector 25 is provided with the crossbar 26. Both sides of the three-way connector 25 on the crossbar 26 are provided with clamps 31 for hanging posters and the like.

Furthermore, for ease of carrying, the end of the frame 1 opposite to the adjustable hanging rack is provided with a handle 32.

Symmetrically provided on a rear side of the end of the frame 1 equipped with the adjustable hanging rack are hooks 33. This configuration allows that, after the puzzle assembly is completed, the bolts connecting the rotating component to the base frame 8 can be unscrewed to detach the rotating component from the base frame 8. Subsequently, the table can be suspended from a nail on a wall via the hooks 33 on the frame 1.

In practical use of the present invention:

Based on their height and sitting posture, the user adjusts the drawing board 6 to the most comfortable tilt angle by engaging the support frame 9 with different positioning slots 10 on the base frame 8.

During puzzle assembly, if rotation of the puzzle area is required, the user simply gently pushes the edge of the frame. The entire tabletop can then rotate smoothly via the steel balls 13 rolling along the circular track 17 at the bottom, with the rubber protrusions 21 and rubber rings 22 providing appropriate damping. Once rotated to the desired angle, it can be locked in place by tightening the positioning bolt 14.

Puzzle pieces can be categorized and placed into the drawers 2 on both sides. Pressing a drawer triggers its spring-assisted ejection, ensuring convenient access.

The complete reference image for the puzzle can be clipped onto the clamps 31 on the crossbar 26. By adjusting the angle of the swivel base 28 and the length of the telescopic rod 24, the image can be positioned optimally above and in front of the drawing board 6. This eliminates the need to look down for reference, significantly protecting the neck and improving puzzle assembly efficiency.

After use, all components can be folded and stored away, saving space.

In the description of the embodiments of the present invention, it should be noted that orientation or positional relationships indicated by terms such as "central," "upper," "lower," "left," "right," "vertical," "horizontal," "inner," "outer," etc., are based on orientation or positional relationships shown in the accompanying drawings, or are the customary orientation or positional relationships when the product of the invention is in use. These terms are used merely for convenience in describing the present invention and for simplifying the description, and do not indicate or imply that the referred apparatus or elements must have a specific orientation or be constructed and operated in a specific orientation. Therefore, such terms should not be construed as limiting the invention. Furthermore, terms such as "first," "second," "third," etc., are used merely for descriptive distinction and should not be understood as indicating or implying relative importance.

Moreover, terms such as "horizontal," "vertical," "suspended," etc., do not require that the components be absolutely horizontal or suspended, but may include slight inclinations. For example, "horizontal" merely indicates that its direction is more horizontal relative to "vertical," and does not mean that the structure must be perfectly level; it can be slightly inclined.

In the description of the embodiments of the present invention, "a plurality of" means at least two.

Furthermore, in the description of the embodiments of the present invention, unless otherwise expressly specified and limited, terms such as "provided," "mounted," "attached," "connected," etc., should be interpreted broadly. For example, they may refer to fixed connections, detachable connections, or integral connections; mechanical connections or electrical connections; direct connections or indirect connections through an intermediary medium; or internal communication between two components. Those of ordinary skill in the art can understand the specific meanings of the above terms in the present invention based on the specific context.

The foregoing describes the present invention and its embodiments. This description is not limiting, and the drawings illustrate only one of the embodiments of the present invention. The actual structure is not limited thereto. In summary, if ordinary technicians in the field are inspired by the present invention and, without departing from the inventive purpose, design similar structural configurations and embodiments to the technical solution without creative effort, such designs shall fall within the protection scope of the present invention.

What is claimed is:

1. An adjustable puzzle table, comprising a frame, drawers, an adjustable support mechanism, a rotating component, and an adjustable hanging rack; both side ends of the frame are symmetrically provided with multiple drawer cavities, each drawer cavity is provided with a drawer; the middle part of the frame is provided with a storage cavity; both side walls of the storage cavity, at positions corresponding to the drawer cavities, are provided with multiple drawer spring mechanisms, the drawer spring mechanisms extend into the drawer cavities and cooperate with the drawers to assist in ejecting the drawers from the drawer cavities; the storage cavity is rotatably provided with the adjustable support mechanism for supporting the frame and enabling adjustment of a tilt angle of the frame; the bottom of the adjustable support mechanism is provided with the rotating component, thereby allowing the puzzle table to rotate 360 degrees horizontally; the front end of the frame is provided with the adjustable hanging rack for hanging posters, placards;

wherein the adjustable support mechanism comprises a base frame and a support frame; the base frame is placed within the storage cavity, and the rear end of the base frame is rotatably connected to both side walls of the storage cavity via bolts; both side walls of the other end of the base frame are uniformly provided with multiple positioning slots; the storage cavity is rotatably provided with the support frame, and the support frame cooperates with the positioning slots for supporting the frame and stabilizing the adjusted position of the frame.

2. The adjustable puzzle table of claim 1, wherein the frame is provided with a drawing board above it, and the drawing board is provided with a U-shaped frame.

3. The adjustable puzzle table of claim 1, wherein the rotating component comprises a circular frame, a circular base, steel balls, and a positioning bolt; the circular frame is internally provided with a mounting bracket connected to the base frame via bolts; the circular frame is internally provided with an annular groove, the top inside the annular groove is provided with a circular track; the upper interior of the circular base is uniformly provided with multiple steel ball seats, each steel ball seat is provided with a steel ball; the circular base is disposed within the annular groove, and the steel balls rolling cooperate with the circular track, thereby enabling relative rotation between the circular base and the circular frame; the side wall of the circular frame is provided with an aperture extending into the annular groove; the outer side wall of the circular frame is provided with an internally threaded sleeve coaxial with the aperture; the internally threaded sleeve is provided with the positioning bolt, and the positioning bolt cooperates with the circular base for positioning the circular base.

4. The adjustable puzzle table of claim 3, wherein both side walls of the annular groove are uniformly provided with multiple rubber protrusions; both side walls of the circular base are provided with rubber rings; the rubber rings cooperate with the rubber protrusions to create a certain resistance.

5. The adjustable puzzle table of claim 1, wherein the adjustable hanging rack comprises a mounting plate, a telescopic rod, a three-way connector, and a crossbar; the mounting plate is connected to the frame via bolts; the upper end of the mounting plate is symmetrically provided with connecting lugs, a swivel base is provided between the two connecting lugs; the swivel base is provided with a through hole penetrating through both connecting lugs laterally; the through hole is provided with a bolt, and the swivel base is rotatably connected to the connecting lugs via the bolt; both sides of the swivel base and the inner sides of the two connecting lugs are provided with teeth; the teeth on both sides of the swivel base mesh with the teeth on the inner sides of the two connecting lugs, thereby achieving positioning of the swivel base; the upper end of the swivel base is provided with the telescopic rod, the upper end of the telescopic rod is provided with the three-way connector, and the three-way connector is provided with the crossbar for hanging posters.

6. The adjustable puzzle table of claim 5, wherein both sides of the three-way connector on the crossbar are provided with clamps.

7. The adjustable puzzle table of claim 1, wherein the end of the frame opposite to the adjustable hanging rack is provided with a handle.

8. The adjustable puzzle table of claim 1, wherein the rear side of the end of the frame provided with the adjustable hanging rack is symmetrically provided with hooks.

* * * * *